US009782872B2

(12) United States Patent
Nie et al.

(10) Patent No.: US 9,782,872 B2
(45) Date of Patent: Oct. 10, 2017

(54) TOOL

(71) Applicants: Saint-Gobain Abrasives, Inc., Worchester, MA (US); Saint-Gobain Abrasifs, Conflans-Sainte-Honorine (FR)

(72) Inventors: Dashi Nie, Pudong (CN); Xiangbin Yu, Shanghai (CN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 14/397,359

(22) PCT Filed: Apr. 24, 2013

(86) PCT No.: PCT/US2013/038009
§ 371 (c)(1),
(2) Date: Oct. 27, 2014

(87) PCT Pub. No.: WO2013/163305
PCT Pub. Date: Oct. 31, 2013

(65) Prior Publication Data

US 2015/0079887 A1 Mar. 19, 2015

(30) Foreign Application Priority Data

Apr. 26, 2012 (CN) ..... 2012 1 0126573
Apr. 26, 2012 (CN) ..... 2012 1 0126607

(51) Int. Cl.
*B24D 3/28* (2006.01)
*B24D 3/20* (2006.01)
(Continued)

(52) U.S. Cl.
CPC ..... *B24D 3/28* (2013.01); *B24D 3/20* (2013.01); *B24D 5/04* (2013.01); *B24D 7/04* (2013.01)

(58) Field of Classification Search
CPC ... B24D 3/28; B24D 5/04; B24D 7/04; B24D 11/02
(Continued)

(56) References Cited

U.S. PATENT DOCUMENTS 2,808,688 A 10/1957 MacMaster
2,814,918 A 12/1957 Erickson
(Continued)

FOREIGN PATENT DOCUMENTS

EP 0078896 A 5/1983
GB 1238446 A 7/1971
(Continued)

OTHER PUBLICATIONS

Bao and Suo, "Remarks on crack-bridging concepts" Applied mechanics review, vol. 45, No. 8, pp. 355-366, 1991.
(Continued)

*Primary Examiner* — Robert Rose
(74) *Attorney, Agent, or Firm* — Abel Law Group, LLP; Thomas Osborn

(57) ABSTRACT

The present invention discloses an improved tool, which comprises a reinforced member; and a resin layer is coated on the reinforced member, wherein the weight of the resin layer per unit area of the reinforced member may be less than 90 g/m$^2$. The weight of the resin layer may be less than 15% of the total weight of the improved tool. The present invention dramatically reduces the production costs while maintaining the application performance unchanged.

17 Claims, 3 Drawing Sheets

(51) Int. Cl.
*B24D 7/04* (2006.01)
*B24D 5/04* (2006.01)

(58) Field of Classification Search
USPC ..... 451/541, 548, 540, 546, 544; 51/297, 51/298
See application file for complete search history.

(56) References Cited

U.S. PATENT DOCUMENTS

| | | | | |
|---|---|---|---|---|
| 3,136,100 | A * | 6/1964 | Robertson, Jr. | B24D 7/16 156/910 |
| 3,250,045 | A * | 5/1966 | Caserta | B24D 7/04 451/548 |
| 3,838,543 | A * | 10/1974 | Lakhani | B24D 5/12 451/546 |
| 3,867,795 | A * | 2/1975 | Howard | C09K 3/1409 451/544 |
| 3,868,793 | A | 3/1975 | Corcoran et al. | |
| 4,230,461 | A | 10/1980 | Sandman et al. | |
| 5,876,470 | A * | 3/1999 | Abrahamson | B24D 3/00 51/307 |
| 6,406,576 | B1 | 6/2002 | Benedict et al. | |
| 6,613,113 | B2 | 9/2003 | Minick et al. | |
| 2002/0077046 | A1 | 6/2002 | Nanjo et al. | |
| 2002/0187737 | A1 | 12/2002 | Stuckenholz et al. | |
| 2004/0043684 | A1 | 3/2004 | Dern et al. | |
| 2009/0280734 | A1 | 11/2009 | Kim | |
| 2010/0180512 | A1 | 7/2010 | Arnaud et al. | |
| 2010/0190424 | A1 | 7/2010 | Francois et al. | |

FOREIGN PATENT DOCUMENTS

| | | | |
|---|---|---|---|
| GB | 2058817 | A | 4/1981 |
| JP | H11216658 | A | 8/1999 |
| WO | 98/23411 | A1 | 6/1998 |

OTHER PUBLICATIONS

International Search Report for PCT/US2013/038009 dated Aug. 9, 2013, 3 pgs.
Victor C. Li and Hwai-Chung Wu, "Conditions for pseudo strain-hardening in fiber reinforced brittle matrix composites", Applied mechanics review, vol. 45, No. 8, pp. 390-398, 1991.
"Glass Fiber Reinforcing disc for bonded abrasive products", Machinery Industry Standards of the People's Republic of China, JP/T 11432-2013, Document Record No. 40436-2013, Published Apr. 25, 2013. 27 pgs. English Translation Attached.
"Glass Fiber reinforced grinding wheel", Nanjing Institute of Industrial Research and Design of Glass Fiber, Information Office, Reinforced Plastics, May 1972. 10 pgs. English Translation Attached.
Han, Huanqiu, "Views on certain problems in grinding wheel mesh production", 1989. 8 pgs. English Translation Attached.
"List of Chinese Exportation of High-tech Products", 2003. 11pgs. English Translation Attached.

* cited by examiner

TOOL

CROSS-REFERENCE TO RELATED APPLICATIONS

This application is the National Stage of International Application No. PCT/US13/38009, entitled "AN IMPROVED TOOL", by Dashi Nie et al., filed Apr. 24, 2013, which claims priority to Chinese Patent Application No. 201210126573.X, entitled "AN IMPROVED TOOL", by Dashi Nie et al., filed Apr. 26, 2012 and Chinese Patent Application No. 201210126607.5, entitled "AN IMPROVED TOOL", by Dashi Nie et al., filed Apr. 26, 2012, both of which are assigned to the current assignee hereof and incorporated herein by reference in their entireties.

FIELD OF THE INVENTION

The present invention relates to a reinforced substrate and an abrasive tool provided with the reinforced substrate, and more particularly to a fiber reinforced mesh for use in abrasive wheels, as well as a thin abrasive wheel comprising the fiber reinforced mesh.

BACKGROUND OF THE INVENTION

Bonding abrasive tools, which usually refer to abrasive wheels, generally consist of an abrasive substrate layer or grinding layer, and a fiberglass reinforced mesh (also called a "fiber reinforced mesh"). Among them, a common effective means to improve the toughness of abrasive wheels, especially resin abrasive wheels, is to use a fiber reinforced mesh as a reinforcement substrate. The fiberglass reinforced mesh functions to improve the toughness of the abrasive wheel to ensure safe operation, so that in high speed rotation, the abrasive wheel will not burst as a result of the centrifugal force to threaten the life and safety of operators. Therefore, the fiberglass reinforced mesh is a reinforcement substrate that is essential in bonding abrasive tools.

In the prior art, the fiberglass reinforced mesh is prepared through a dipping process, in which a woven fiberglass fabric is dipped into a resin sizing agent and, after drying, and dried fiberglass reinforced mesh has a fiber fabric layer in the middle and resin layers on the upper and lower surfaces. A resin layer, also called a combustible layer, is generally formed by solidifying a thermoset resin such as epoxy resin or phenolic resin together with a solvent, a surfactant, and an aid and the like. For those skilled in the art, the resin layer is essential and must have a certain thickness, as it has the following functions:

1. it provides a strong texture interface after the fiberglass reinforced mesh is solidified so as to enhance the hardness of the fiberglass reinforced mesh;

2. it ensures that the fiberglass reinforced mesh meets the process requirements, that is to say, possesses a certain toughness and flatness;

3. in pressing the abrasive wheel, it protects the fiberglass fabric from being squeezed and thus damaged by abrasive particles;

4. it provides chemical bonds to effectively bind the abrasive substrate with the fiberglass fabric.

Therefore, the structure of the fiberglass reinforced mesh of the prior art is as follows:

1. it has a fiberglass fabric layer;

2. the fiberglass fabric layer is coated with phenolic resin on either surface through the dipping process;

3. in the fiberglass mesh, the weight of the resin material per $m^2$ shall be more than 90 g (or called "resin content" hereinbelow, unit: $g/m^2$);

4. the combustible content in the fiberglass mesh (i.e., the weight percentage of the solidified dip coating relative to the whole mesh, or the weight percentage of the resin relative to the whole mesh, both of which are referred to as "resin content" hereinbelow for convenience of understanding) shall be in the range of more than 30%.

According to the above description of existing technical solutions, the fiberglass mesh must comprise a relatively high resin content for the reason that the burst speed and the grinding rate (removal amount of materials/wear extent of abrasive wheel) are two important performance indexes for abrasive wheels, especially thin abrasive wheels, and in order that the abrasive wheel does not burst at a high rotation speed, the abrasive wheel, especially the thin abrasive wheel, must be reinforced through a fiberglass mesh coated with a phenol-based dip coating. In practice, the content of the resin material is at least more than 90 g/m2 in the fiber reinforced mesh, and is about 100 g/m2 in common fiber reinforced meshes. The resin content per unit area may be measured by the following method. According to current national standards relating to the mechanical industry in China, the fiber reinforced mesh for bonding abrasive tools shall have a resin content of not less than 28%. The resin content may be measured by the following method.

The mass of a fiberglass reinforced mesh sample is weighed and marked as W1. The sample is placed into a cabinet drier where it is dried at 160° C.±2° C. for 20 minutes, removed, and then placed into a drier to cool down to room temperature. The mass of the sample is weighed and marked as W2. Then, the sample is placed into a high temperature furnace where it is ignited at 600° C.±20° C. for 1 hour, removed and then placed into a drier to cool down to room temperature. The mass of the sample is weighed and marked as W3. The resin weight per unit area of the fiberglass reinforced mesh is calculated by a formula as follows:

$$\text{Resin weight(resin content)per unit area}=(W1-W3)/\text{mesh area}$$

As conceived by those skilled in the art, the fiberglass can have a certain rigidity and interfacial strength and the abrasive wheel can possess a reliable burst speed only when the weight of the resin material per m2 of the fiber reinforced mesh on average is at least more than 90 g.

$$\text{Combustible content(resin content)}=(W1-W3)/W1\times 100\%$$

As conceived by those skilled in the art, a resin content of more than 28% can provide the fiberglass with a certain rigidity and interfacial strength and ensure that the abrasive wheel possesses a reliable burst speed.

Furthermore, in current production practices, the glass reinforced mesh for abrasive wheels has a resin content of 33%±3%.

However, the fiberglass reinforced mesh of the prior art has the following deficiencies:

1. The costs of raw materials are high. It is widely believed by those skilled in the art that, in order to ensure the reliability and toughness of the abrasive wheel, the resin content of its fiberglass mesh shall be at least more than 90 g/m2, so a great deal of resin is coated on the fiberglass fabric layer. It is widely believed by those skilled in the art that, in order to ensure the reliability and toughness of the abrasive wheel, the resin content of its fiberglass mesh shall not be less than 28%, so a great deal of resin is coated on the fiberglass fabric layer. The costs of resin generally account for 30-50% of the costs of the fiberglass reinforced mesh, while the costs of the fiberglass reinforced mesh in turn account for 20-40% of the costs of the abrasive wheel.

2. The fiberglass mesh is coated with much resin and thus is overall relatively thick. As a result, abrasive wheels, especially thin abrasive wheel, in fabrication cannot be thinner (thinner abrasive wheels can save materials to be processed in metal processing, which is especially important in noble metal processing); or, in order to ensure the thickness, adding sufficient substrate materials in the abrasive substrate layer has to be given up or cannot be achieved.

3. The excessive use of resin layer material pollutes the environment and adversely affects human health, because thermoset resins such as phenolic resin release formaldehyde and other toxic volatile compound gases.

SUMMARY OF THE INVENTION

An objective of the present invention is to provide a fiber reinforced mesh, which uses less resin materials to address the above deficiencies and problems present in the prior art. More importantly, it eliminates a long-standing technical prejudice by those skilled in the art, that is, the burst of the fiberglass reinforced mesh for bonding abrasive tools or abrasive wheels is related to the resin content of the reinforced mesh, and only a resin content higher than 90 g/m2, and the resin content of the reinforced mesh, and the resin content must be higher than 28%, to ensure the working functions including the toughness of the abrasive wheel and ensure a high burst speed of the abrasive wheel so as to conform to the safety standards.

Those skilled in the art have such a technical prejudice because: an abrasive wheel, especially a thin abrasive wheel, in high-speed cutting or grinding operation, will suffer a circumferential tensile stress as a result of the centrifugal force, and thus an object rotating at a high speed easily bursts. In order to improve the burst speed, the abrasive wheel must be provided with fiberglass coated with a resin layer, and these extendable fiberglass bundles can provide a crack bridging force to toughen the brittle abrasive substrate layer and hence reduce the crack tip stress in the abrasive substrate layer. As believed by those skilled in the art, after the fiberglass is coated with more than 90 g/m2 or about 40% of phenolic resin through dipping, a solid fiber/abrasive interfacial layer is formed between the fiberglass reinforced mesh and the abrasive substrate of the abrasive wheel after solidification as a result of such coating, which can reinforce the abrasive wheel and reduce the possibility of burst of the abrasive wheel rotating at a high speed.

However, the inventor of this present invention studied and found that there is no monotonic relationship between the burst speed of the abrasive wheel and the coating amount of phenolic resin, that is to say, a higher coating amount of resin does not mean a higher burst speed of the abrasive wheel; for the grinding ratio of the abrasive wheel, as shown by further test data, a small coating amount of resin only slightly reduces the grinding ratio of the abrasive wheel, which is still within the acceptable range of the requirements of grinding operation. Therefore, the coating amount of resin can be considerably reduced.

The present invention is based on the following principle: according to the theory of mesomechanics [Victor C. Li and Hwai-Chung Wu, Conditions for pseudo strain-hardening in fiber reinforced brittle matrix composites, Applied mechanics review, Vol 45, No 8, pp 390-398, 1991; G Bao and Z Suo, Remarks on crack-bridging concepts, Applied mechanics review, Vol 45, No 8, pp 355-366, 1991], for brittle materials reinforced by continuous fiber, it is unnecessary to make the interface of the fiber/abrasive substrate layer the solidest; while the relationship between the fiber bridging force and the crack opening displacement is of critical importance for the fiber reinforcement effects, the reason for this is that the energy enclosed by the force/displacement curve is directly correlated with the fracture toughness of the composite material. Generally speaking, at a given fiber bridging force, a relatively large crack opening displacement tends to provide a more flexible fiber/grinding substrate combination.

For continuous fiber reinforcement, the factor that causes fiber failure generally lies in fiber fracture rather than pulling out from the abrasive substrate layer. For a given reinforcement fiber, the maximum crack bridging force is irrelated to the interfacial properties of the fiber/abrasive substrate layer. However, the interfacial properties affect the crack opening displacement. Take a simple example: grasp one end of an elastic rope embedded in soil (low interfacial strength) or concrete (high interfacial strength) and pull the rope out by some force; before the rope is ruptured, it can be pulled out from soil a lot but cannot be pulled out from concrete at all. As expressed by a term of the fracture mechanics, the length of the rope that is pulled out is called crack opening displacement. Therefore, especially for abrasive wheels reinforced by the continuous fiber arrangement, it is unnecessary to deliberately adopt an especially high interfacial strength between the fiberglass reinforced mesh and the abrasive substrate layer of the abrasive wheel.

As can be seen from the above analysis, it is unnecessary to provide an especially high interfacial strength between the fiberglass reinforced mesh and the abrasive substrate layer of the abrasive wheel. On the contrary, the action or effect of a relatively weak interfacial strength is not poorer than that of a high interfacial strength. Coating a great deal of resin on the fiberglass fabric layer is a technical prejudice of those skilled in the art. When a small amount of resin or even no resin is applied, an interface with a low strength or a purely physical-contact interface forms between the fiberglass reinforced mesh and the abrasive substrate layer, which can still ensure the toughness and other properties of the abrasive tools.

In conclusion, the present invention provides a fiber reinforced mesh for an abrasive wheel, which comprises a fiber fabric layer; a resin layer is coated on the fiber fabric layer; and the weight of the resin layer per unit area of the fiber reinforced mesh is less than 90 g/m2; preferably, the weight of the resin layer per unit area of the fiber reinforced mesh is more than 3 g/m2.

Optionally, the weight of the resin layer per unit area of the fiber reinforced mesh is more than 5 g/m2, 10 g/m2, 15 g/m2, 20 g/m2, 25 g/m2, 30 g/m2, 35 g/m2, 40 g/m2, 45 g/m2, 50 g/m2, 55 g/m2, or 60 g/m2; or less than 85 g/m2, 80 g/m2, 75 g/m2, 70 g/m2, 65 g/m2, 60 g/m2, 55 g/m2, 50 g/m2, 45 g/m2, or 40 g/m2.

The weight of the resin material per unit area of the fiber reinforced mesh is preferably 5-90 g/m2 and more preferably 35-90 g/m2.

The weight of the resin layer also may be less than 15% of the total weight of the fiber reinforced mesh; preferably, the weight of the resin layer is more than 1% of the total weight of the fiber reinforced mesh. Optionally, the resin layer can account for more than 2%, 3%, 4%, 5%, 6%, 7%, 8%, 9%, 10%, 11%, 12%, or 13%, or less than 13%, 12%, 11%, 10%, 9%, 8%, 7%, 6%, or 5% of the total weight of the fiber reinforced mesh. Preferably, the resin material accounts for 5%-14% and more preferably 11%-14% of the total weight of the fiber reinforced mesh.

In a preferred embodiment, the resin layer comprises one of thermoset resins including phenolic resin, aniline-formaldehyde resin, melamine resin, epoxy resin or modified epoxy resin, furfural resin, phenol formaldehyde, furan resin, glyptal resin, polyester or modified polyester, and vulcanized rubber, or any combination thereof.

Preferably, the fiber fabric layer can be fiberglass mesh, short fiberglass, or nylon yarn.

On the other hand, the present invention further provides an abrasive wheel provided with a fiber reinforced mesh, comprising an abrasive substrate layer or grinding layer, wherein at least one fiber reinforced mesh is provided inside of or on a surface of the abrasive substrate layer or grinding layer; the fiber reinforced mesh includes a fiber fabric layer; a resin layer is coated on the fiber fabric layer; and the weight of the resin layer per unit area of the fiber reinforced mesh is less than 90 g/m2. Preferably, the weight of the resin layer per unit area of the fiber reinforced mesh is more than 3 g/m2.

In a preferred embodiment, when more than two fiber reinforced meshes are provided, the weight of the resin material per unit area of each fiber reinforced mesh is different from one another.

In another preferred embodiment, when more than two fiber reinforced meshes are provided, the weight of the resin material of at least one fiber reinforced mesh per unit area is less than 90 g/m2, and the weight of the resin material of the remaining fiber reinforced meshes per unit area is more than 90 g/m2.

Preferably, the resin layer comprises one of thermoset resins including phenolic resin, aniline-formaldehyde resin, melamine resin, epoxy resin or modified epoxy resin, furfural resin, phenol formaldehyde, furan resin, glyptal resin, polyester or modified polyester, and vulcanized rubber, or any combination thereof.

Preferably, the fiber fabric layer can be fiberglass mesh, short fiberglass, or nylon yarn.

According to an embodiment, the abrasive wheel may comprise a layer of fiber reinforced mesh which is provided inside the abrasive substrate of the abrasive wheel.

According to another embodiment, the abrasive wheel may comprise a first fiber reinforced mesh and a second fiber reinforced mesh which are respectively provided on outer surfaces at two opposite sides of the abrasive substrate of the abrasive wheel.

According to another embodiment, the abrasive wheel comprises a first fiber reinforced mesh completely overlaid on an outer surface of the abrasive substrate of the abrasive wheel, a second fiber reinforced mesh provided inside the abrasive wheel, and a third fiber reinforced mesh partially overlaid on the other outer surface of the abrasive substrate of the abrasive wheel.

Preferably, the abrasive wheel is a thin abrasive wheel, and particularly a cutting wheel or angle grinding disk.

The beneficial effects of the present invention are as follows: on the premise that the performance of the abrasive wheel remains unchanged, that is to say, both of the grinding ratio and the burst speed meet the industrial codes and standards, the present invention has the following advantages.

1. The raw material costs of the fiber reinforced mesh or abrasive wheel are reduced by reducing the consumption of resin.

2. The abrasive wheel, especially thin abrasive wheel, becomes thinner, or it is retained with more space where other materials that are helpful to improve its performance are introduced.

3. The release of formaldehyde or other toxic volatile gases is reduced to protect the environment and human health.

DETAILED DESCRIPTION OF THE INVENTION

Figure 1:
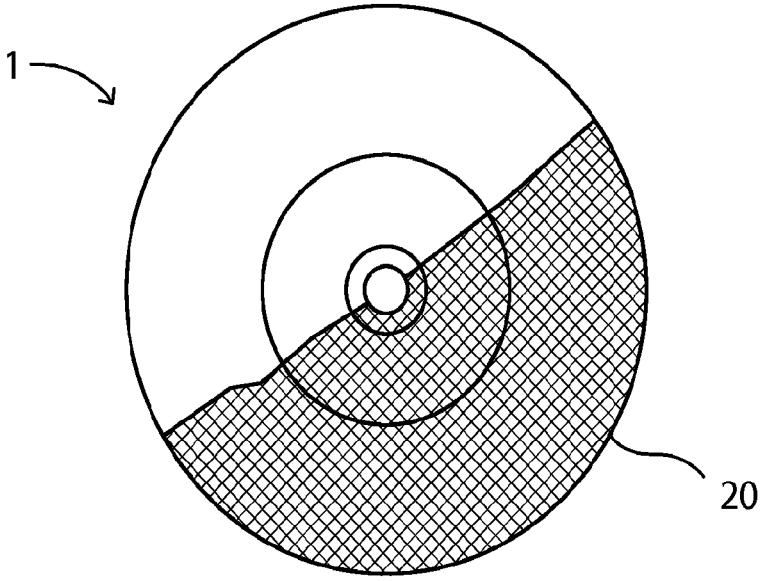
FIG. 1 is a structural schematic view of a fiber reinforced mesh.

FIG. 1 shows a fiber reinforced mesh, wherein a layer of fiber fabric is firstly coated with a resin layer on each of the upper and lower surfaces through a dipping process and the like, then solidified by heating, and finally cut into a fiber reinforced mesh. The resin layer is produced by solidifying phenolic resin together with a solvent, a surfactant, and an aid and the like. After solidification by heating, the weight of the resin layer per m2 of the fiber reinforced mesh is more than 3 g and less than 90 g; for the convenience of large-scale production, the weight of the resin material per unit area of the fiber reinforced mesh is preferably between 5-90 g, and more preferably between 35-90 g.

Figure 7:
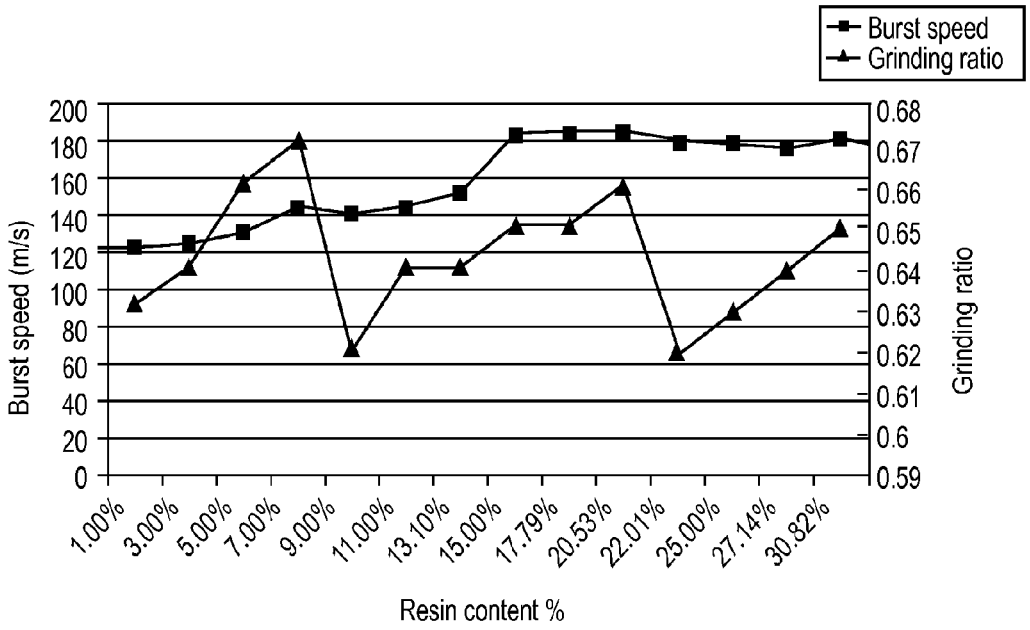
FIGS. 7 and 8 show the effects of the resin content on the burst speed and the grinding ratio.

An example of the present invention is based on an ultra-thin abrasive wheel with a diameter of 105 mm, where two fiber reinforced mesh layers are each provided on an outer surface at either side of an abrasive substrate layer of the abrasive wheel. The cross-sectional structure of this example is similar to that shown in FIG. 3. The content of the phenolic resin coating on the glass reinforced mesh is gradually reduced from about 98 g/m2 as specified in the current production practice standard to about 3 g/m2. FIG. 7 shows the values of the burst speed and the grinding ratio for abrasive wheels comprising fiber reinforced meshes with different weights of resin per unit area, and the test results show that reduction of the resin content in the fiber reinforced mesh has slight effects on the burst speed and the grinding ratio; and when the resin content of the fiber reinforced mesh in the abrasive wheel is gradually reduced to 3 g/m2, the grinding ratio remains substantially unchanged, and the burst speed still conforms to the requirements of the grinding process.

More examples and performance tests on abrasive wheels are provided hereinbelow.

Example 1

Figure 3:
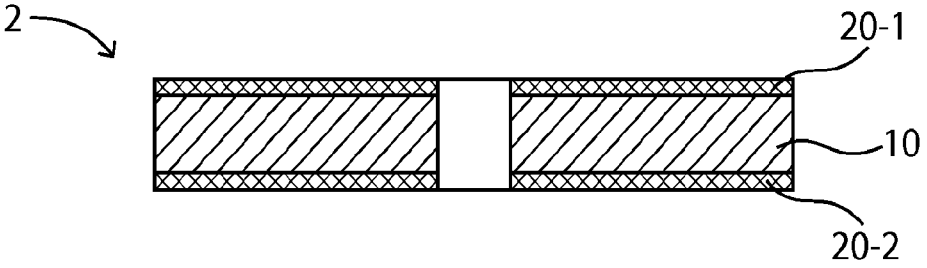
FIG. 3 is a cross-sectional schematic view of an abrasive wheel of a second embodiment according to the present invention.

Firstly, cutting wheels with a size of 180×3×22 (mm) were tested. The structure of the cutting wheel is as shown in FIG. 3. The cutting wheel comprises a grinding layer 10 and two fiber reinforced mesh layers 20-1 and 20-2 are respectively provided on the upper and lower surfaces on the grinding layer 10. According to the specifications as set forth in a national standard of the People's Republic of China GB/T2485-2008 Technical Conditions for Bonding Abrasive Tools, the burst performance of an abrasive wheel shall be tested in accordance with a rotation test method on abrasive wheels as provided in a national standard of the People's Republic of China GB/T2493-1995 and shall conform to the related requirements.

Thus, the abrasive wheel of this embodiment was tested according to the national standard GB/T2493-1995, where the abrasive wheel was installed on a rotation testing machine (a POGGI rotation machine from Italy, type: PV22, maximum rotation speed: 22000 rpm) as specified in the standard. The weight of the resin layer per unit area of the single fiber reinforced meshes 20-1 and 20-2 is respectively set to be 3.2, 9.6, 16, 22.4, 28.8, 35.2, 41.9, 48, 56.9, 65.6, 70.4, 79.9, 86.8 and 98.6 (g/m2), and the cutting wheels were subject to the rotation test at 1.5 times their respective maximum operation speeds and maintained at the highest speed for 30 seconds. The results showed that all the tested cutting wheels passed the test.

During the test, even if the resin content in a single fiber reinforced mesh is as low as about 3 g/m2, the cutting wheel did not burst and successfully passed the rotation test. Further, the inventor of the present invention measured the grinding ratios of these cutting wheels and compared them with those in the case of more than 90 g/m2. For details, refer to Table 1. This shows that the resin content in the fiber reinforced mesh does not affect the grinding ratio of the cutting wheel.

TABLE 1

| Resin weight per unit area of fiber reinforced mesh ($g/m^2$) | Rotation test | Grinding ratio |
|---|---|---|
| 3.2 | Pass | 0.63 |
| 9.6 | Pass | 0.64 |
| 16 | Pass | 0.66 |
| 22.4 | Pass | 0.67 |
| 28.8 | Pass | 0.62 |
| 35.2 | Pass | 0.64 |
| 41.9 | Pass | 0.64 |
| 48 | Pass | 0.65 |
| 56.9 | Pass | 0.65 |
| 65.6 | Pass | 0.66 |
| 70.4 | Pass | 0.62 |
| 79.9 | Pass | 0.63 |
| 86.8 | Pass | 0.64 |
| 98.6 | Pass | 0.65 |

Example 2

Figure 2:
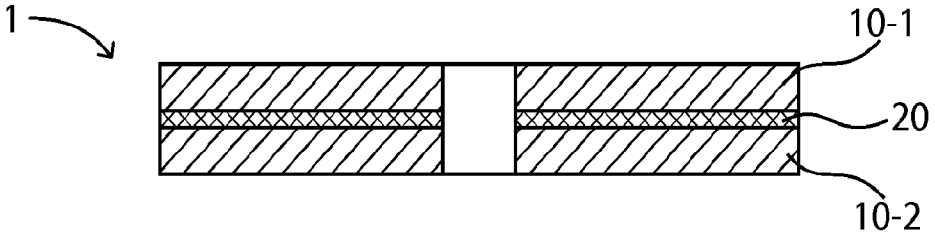
FIG. 2 is a cross-sectional schematic view of an abrasive wheel of a first embodiment according to the present invention.

Cutting wheels with the same size of 180×3×22 (mm) were tested. The cutting wheels in Example 2 are different from those in Example 1 and the cross-sectional structure of this group of cutting wheels is shown in FIG. 2. The grinding layer of the cutting wheel is divided into a first grinding layer 10-1 and a second grinding layer 10-2, and the cutting wheel comprises a fiber reinforced mesh 20 between the first grinding layer and the second grinding layer. The tests include a rotation test and a grinding ratio measurement test. The conditions of the rotation test are the same as those in Example 1, and according to the tests, all tested cutting wheels passed the test and changes in the resin weight per unit area of the reinforced mesh did not affect the grinding ratio of the cutting wheel.

TABLE 2

| Resin weight per unit area of fiber reinforced mesh ($g/m^2$) | Rotation test | Grinding ratio |
|---|---|---|
| 3.2 | Pass | 1.01 |
| 9.6 | Pass | 1.03 |
| 16 | Pass | 1.04 |
| 22.4 | Pass | 1.02 |
| 28.8 | Pass | 1.06 |
| 35.2 | Pass | 1.06 |
| 41.9 | Pass | 1.05 |
| 48 | Pass | 1.04 |
| 56.9 | Pass | 1.03 |
| 65.6 | Pass | 1.02 |
| 70.4 | Pass | 1.07 |
| 79.9 | Pass | 1.04 |
| 86.8 | Pass | 1.03 |
| 98.6 | Pass | 1.05 |

Example 3

Figure 4:
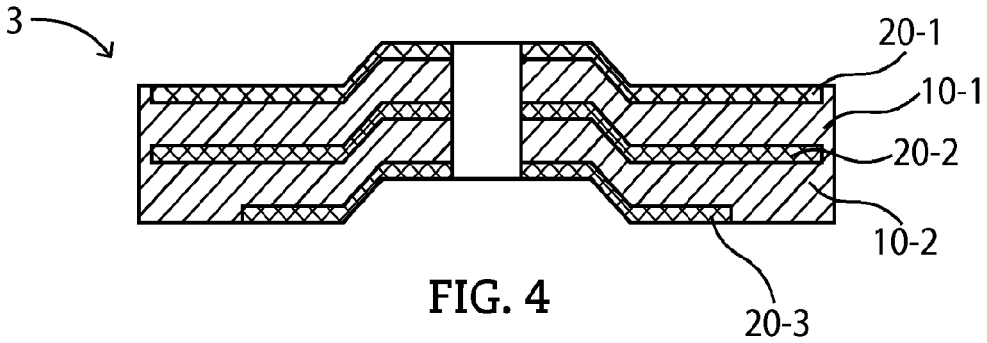
FIG. 4 is a cross-sectional schematic view of an abrasive wheel of a third embodiment according to the present invention.

The inventor further tested angle grinding disks with a cross-sectional structure as shown in FIG. 4. The angle grinding disk has a size of 180×6×22 (mm), and comprises, along the direction as shown in FIG. 4 from top down, a first fiber reinforced mesh 20-1 overlaid on an upper surface of the grinding layer, a second fiber reinforced mesh 20-2 provided inside the grinding layer, and a third fiber reinforced mesh 20-3 partially overlaid on a lower surface of the grinding layer. The tests include a rotation test and a grinding ratio measurement test. The conditions of the rotation test are the same as those in Example 1. As shown in Table 3 hereinbelow, all the angle grinding disks passed the tests and changes in the resin weight per unit area of the fiber reinforced mesh did not affect the grinding ratio of the angle grinding disk.

TABLE 3

| Resin weight per unit area of fiber reinforced mesh ($g/m^2$) | Rotation test | Grinding ratio |
|---|---|---|
| 3.2 | Pass | 11.9 |
| 9.6 | Pass | 12.5 |
| 16 | Pass | 12.3 |
| 22.4 | Pass | 12.4 |
| 28.8 | Pass | 12.4 |
| 35.2 | Pass | 12.8 |
| 41.9 | Pass | 11.9 |
| 48 | Pass | 11.8 |
| 56.9 | Pass | 12.3 |
| 65.6 | Pass | 12.2 |
| 70.4 | Pass | 12.4 |
| 79.9 | Pass | 12.6 |
| 86.8 | Pass | 12.2 |
| 98.6 | Pass | 12.8 |

Example 4

The inventor further tested cutting wheels with a size of 350×3×25. The structure of the cutting wheel is shown in FIG. 3. The grinding layer of the cutting wheel is divided into a first grinding layer 10-1 and a second grinding layer 10-2, and the cutting wheel comprises a fiber reinforced mesh 20 between the first grinding layer and the second grinding layer. The tests include a rotation test and a grinding ratio measurement test. The conditions of the rotation test are the same as those in Example 1, and according to the test, all tested cutting wheels passed the tests and changes in the resin weight per unit area of the reinforced mesh did not affect the grinding ratio of the cutting wheel.

TABLE 4

| Resin weight per unit area of fiber reinforced mesh ($g/m^2$) | Rotation test | Grinding ratio |
|---|---|---|
| 61.3 | Pass | 0.66 |
| 68.2 | Pass | 0.64 |
| 69.8 | Pass | 0.63 |
| 77.2 | Pass | 0.64 |
| 92.5 | Pass | 0.65 |

Example 5

The inventor further tested cutting wheels with a size of 350×3×25. The structure of the cutting wheel is as shown in FIG. 2. The cutting wheel comprises a grinding layer 10, and two layers of fiber reinforced mesh 20-1 and 20-2 are each provided on the upper and lower surfaces of the grinding layer 10. The tests include a rotation test and a grinding ratio measurement test. The conditions of the rotation test are the same as those in Example 1. As shown by the test, all the cutting wheels passed the test and changes in the resin weight per unit area of the reinforced mesh did not affect the grinding ratio of the cutting wheel.

TABLE 5

| Resin weight per unit area of fiber reinforced mesh ($g/m^2$) | Rotation test | Grinding ratio |
|---|---|---|
| 61.3 | Pass | 0.82 |
| 68.2 | Pass | 0.81 |
| 69.8 | Pass | 0.84 |
| 77.2 | Pass | 0.86 |
| 92.5 | Pass | 0.85 |

Based on the above three examples, it can be concluded that, when the resin content in the fiber reinforced mesh is reduced to be below 90 g/m2 which is traditionally considered as undesirable, both the burst speed and the cutting rate are not significantly influenced. That is to say, the resin content in the fiber reinforced mesh may be set to be below 90 g/m2 and above 3 g/m2. Nevertheless, considering the costs in conjunction with the workability, the weight of the resin material per m2 of the fiber reinforced mesh may be preferably set to be 5-90 g/m2, and more preferably 35-90 g/m2.

Furthermore, the fiber reinforced mesh with the resin content reduced to be below 90 g/m2 may be incorporated into the grinding substrate layer of the abrasive wheel through various ways. In addition to the three different patterns as shown in Examples 1 to 3, the fiber reinforced mesh may further have the following structures.

Figure 5:
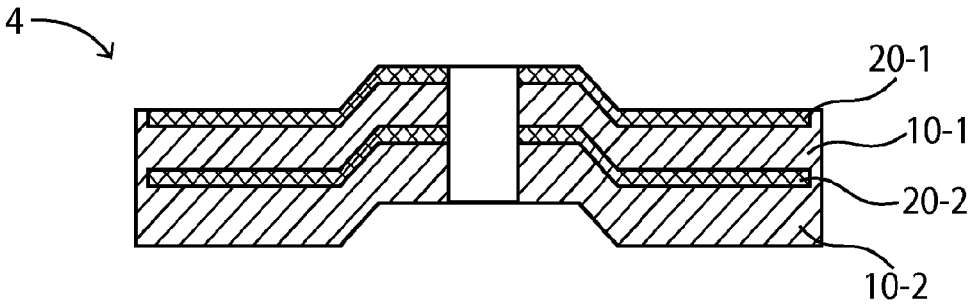
FIG. 5 is a cross-sectional schematic view of an abrasive wheel of a fourth embodiment according to the present invention.

As shown in FIG. 5, an abrasive wheel 5 may comprise two layers of complete fiber reinforced mesh 20-1 and 20-2, wherein the first fiber reinforced mesh layer 20-1 is provided on one of the two outer surfaces of the substrate of the abrasive wheel, and the second fiber reinforced mesh layer 20-2 is axially provided inside the substrate of the abrasive wheel at an approximately middle position.

Figure 6:
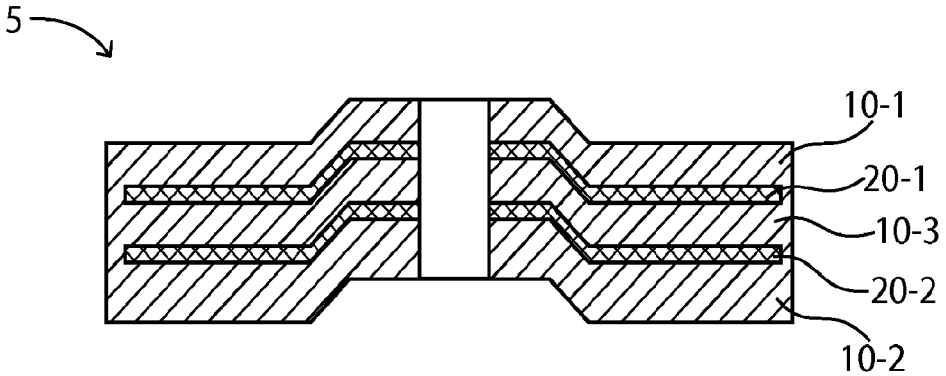
FIG. 6 is a cross-sectional schematic view of an abrasive wheel of a fifth embodiment according to the present invention.

Further, as shown in FIG. 6, an abrasive wheel 6 comprises two layers of complete fiber reinforced mesh 20-1 and 20-2 which are both provided inside the abrasive substrate of the abrasive wheel and divide the abrasive substrate into three layers.

For the abrasive wheels provided with multi-layer fiber reinforced meshes as shown in FIGS. 4, 5 and 6, when prefabricated, the coated resin contents of all the fiber reinforced meshes are less than 90 g/m2, and the fiber reinforced meshes have the same resin weight per unit area.

The overall inventive concept of the present invention is described through some specific embodiments, but the methods provided in the above related description or embodiments do not represent a sole option and various changes or combinations may be made to what is described in the specification by those skilled in the art. For example, in the abrasive wheel provided with more than two fiber reinforced meshes, the resin weights per unit area of the fiber reinforced meshes may be different: the resin content of one fiber reinforced mesh may be 35 g/m2 and that of the other may be 65 g/m2; or, the resin content of one fiber reinforced mesh is within the scope as set forth in the claims, and the other may use a traditional fiber reinforced mesh with a resin content of more than 90 g/m2.

Again referring to FIG. 1, after solidification by heating, the resin layer accounts for equal to or more than 1% and less than 15% of the total weight of the fiber reinforced mesh, and for the convenience of large-scale production, the weight percentage of the resin layer can be preferably 11%, 12%, 13% and 14% relative to the fiber reinforced mesh.

Figure 8:
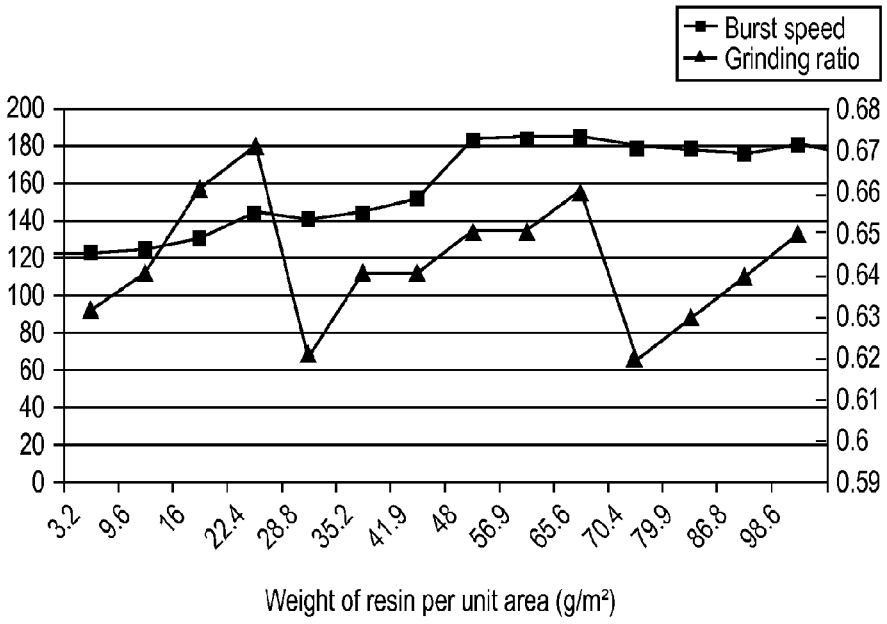

An example of the present invention is based on an ultra-thin abrasive wheel with a diameter of 105 mm, where two layers of fiber reinforced mesh are each provided on an outer surface at either side of an abrasive substrate layer of the abrasive wheel. The cross-sectional structure of this example is similar to that shown in FIG. 3. The content of the phenolic resin coating on the glass reinforced mesh is gradually reduced from 33% as specified in the current production practice standard to 1%. FIG. 8 shows the values of burst speed and grinding ratio for abrasive wheels comprising fiber reinforced meshes with different resin contents, and the test results show that the reduction of resin content in the fiber reinforced mesh has slight effects on the burst speed and the grinding ratio; and when the resin content of the fiber reinforced mesh in the abrasive wheel is gradually reduced to 1%, the grinding ratio remains unchanged, and the burst speed is slightly reduced but still conforms to the requirements of the grinding process.

More examples and performance tests on abrasive wheels are provided hereinbelow.

Example 6

Cutting wheels with a size of 180×3×22 (mm) were tested. The structure of the cutting wheel is as shown in FIG. 3, comprising a grinding layer 10 and two layers of fiber reinforced mesh 20-1 and 20-2 provided respectively on the upper and lower surfaces of the grinding layer 10.

According to the specifications as set forth in a national standard of the People's Republic of China GB/T2485-2008 Technical Conditions for Bonding Abrasive Tools, the burst performance of an abrasive wheel shall be tested in accordance with a rotation test method of abrasive wheels as provided in a national standard of the People's Republic of China GB/T2493-1995 and shall conform to the related requirements.

Thus, the abrasive wheel of this embodiment was tested according to the national standard GB/T2493-1995, where the abrasive wheel was installed on a rotation testing machine (a POGGI rotation machine from Italy, type: PV22, maximum rotation speed: 22000 rpm) as specified in the standard. The resin content in each of the fiber reinforced meshes 20-1 and 20-2 was set to be 1.00%, 3.00%, 5.00%, 7.00%, 9.00%, 11.00%, 13.10% and 15.00% respectively, and the cutting wheels were subject to the rotation test at 1.5 times their respective maximum operation speed and maintained at the highest speed for 30 seconds. The results show that all the tested cutting wheels pass the test.

During the test, even if the resin content in a single fiber reinforced mesh was as low as 1.00%, the cutting wheel did not burst and successfully passed the rotation test. Further, the inventor measured grinding ratios of these cutting wheels and compared them with those when the resin content thereof was more than 15%. For details, refer to Table 6. As can be seen, the resin content in the fiber reinforced mesh does not affect the grinding ratio of the cutting wheel.

TABLE 6

| Resin content | Rotation test | Grinding ratio |
|---|---|---|
| 1.00% | Pass | 0.63 |
| 3.00% | Pass | 0.64 |
| 5.00% | Pass | 0.66 |
| 7.00% | Pass | 0.67 |
| 9.00% | Pass | 0.62 |
| 11.00% | Pass | 0.64 |
| 13.10% | Pass | 0.64 |
| 15.00% | Pass | 0.65 |
| 17.79% | Pass | 0.65 |
| 20.53% | Pass | 0.66 |
| 22.01% | Pass | 0.62 |
| 25.00% | Pass | 0.63 |
| 27.14% | Pass | 0.64 |
| 30.82% | Pass | 0.65 |

Example 7

Next, cutting wheels with the same size of 180×3×22 (mm) were tested. The cutting wheels in Example 7 are different from those in Example 6, and the cross-sectional structure of this group is shown in FIG. 2. The grinding layer of such a cutting wheel is divided into a first grinding layer 10-1 and a second grinding layer 10-2, and the cutting wheel comprises a fiber reinforced mesh 20 between the first grinding layer and the second grinding layer. The tests include a rotation test and a grinding ratio measurement test. The conditions of the rotation test are the same as those in Example 6, and according to the test, all tested cutting wheels passed the tests and the resin content in the reinforced mesh does not affect the grinding ratio of the cutting wheel.

TABLE 7

| Resin content | Rotation test | Grinding ratio |
|---|---|---|
| 1.00% | Pass | 1.01 |
| 3.00% | Pass | 1.03 |

TABLE 7-continued

| Resin content | Rotation test | Grinding ratio |
|---|---|---|
| 5.00% | Pass | 1.04 |
| 7.00% | Pass | 1.02 |
| 9.00% | Pass | 1.06 |
| 11.00% | Pass | 1.06 |
| 13.10% | Pass | 1.05 |
| 15.00% | Pass | 1.04 |
| 17.79% | Pass | 1.03 |
| 20.53% | Pass | 1.02 |
| 22.01% | Pass | 1.07 |
| 25.00% | Pass | 1.04 |
| 27.14% | Pass | 1.03 |
| 30.82% | Pass | 1.05 |

Example 8

The inventor further tested angle grinding disks with a cross-sectional structure as shown in FIG. 4. The angle grinding disk has a size of 180×6×22 (mm), and comprises, along the direction as shown in FIG. 4 from top down, a first fiber reinforced mesh 20-1 overlaid on an upper surface of the grinding layer, a second fiber reinforced mesh 20-2 provided inside the grinding layer, and a third fiber reinforced mesh 20-3 partially overlaid on a lower surface of the grinding layer. The tests include a rotation test and a grinding ratio measurement test. The conditions of the rotation test are the same as those in Example 6. As shown in Table 8 below, all the angle grinding disks passed the test and the resin content in the fiber reinforced mesh did not affect the grinding ratio of the angle grinding disk.

TABLE 8

| Resin content | Rotation test | Grinding ratio |
|---|---|---|
| 1.00% | Pass | 11.9 |
| 3.00% | Pass | 12.5 |
| 5.00% | Pass | 12.3 |
| 7.00% | Pass | 12.4 |
| 9.00% | Pass | 12.4 |
| 11.00% | Pass | 12.8 |
| 13.10% | Pass | 11.9 |
| 15.00% | Pass | 11.8 |
| 17.79% | Pass | 12.3 |
| 20.53% | Pass | 12.2 |
| 22.01% | Pass | 12.4 |
| 25.00% | Pass | 12.6 |
| 27.14% | Pass | 12.2 |
| 30.82% | Pass | 12.8 |

Based on the above three examples, it can be concluded that, when the resin content in the fiber reinforced mesh is reduced to below 15% which is traditionally considered as undesirable, both the burst speed and the cutting rate are not significantly influenced. That is to say, the resin content in the fiber reinforced mesh may be set to below 15% and above 1%. Nevertheless, considering the costs in conjunction with the workability, the resin content in the fiber reinforced mesh may be preferably set to between 5% and 14%, and more preferably between 11% and 14%.

Furthermore, the fiber reinforced mesh with the resin content reduced to below 15% may be incorporated into the grinding substrate layer of the abrasive wheel through various methods. In addition to the three different patterns as shown in Examples 6 to 8, the fiber reinforced mesh may further have the following structures.

As shown in FIG. 5, an abrasive wheel 5 may comprise two layers of complete fiber reinforced mesh 20-1 and 20-2, wherein the first layer of fiber reinforced mesh 20-1 is provided on one of the two outer surfaces of a substrate of the abrasive wheel, and the second layer of fiber reinforced mesh 20-2 is axially provided inside the substrate of the abrasive wheel at an approximately central position.

Further, as shown in FIG. 6, an abrasive wheel 6 comprises two layers of complete fiber reinforced mesh 20-1 and 20-2 which are both provided inside an abrasive substrate of the abrasive wheel and divide the abrasive substrate into three layers.

For the abrasive wheels provided with multi-layer fiber reinforced meshes as shown in FIGS. 4, 5 and 6, when prefabricated, all the fiber reinforced meshes have the same resin content which is less than 15% of the total weight of the mesh.

The overall inventive concept of the present invention is described through some specific embodiments, but the methods provided in the above related description or embodiments do not all represent a sole option and various changes or combinations may be made to what is described in the specification by those skilled in the art. For example, in the abrasive wheel provided with more than two fiber reinforced meshes, the resin contents thereof may be different: the resin content of one fiber reinforced mesh may be 14% and that of the other may be 10%; or, the resin content of one fiber reinforced mesh is within the scope as set forth in the claims, while that of the other may be more than 15% or traditionally more than 28%.

Therefore, after reading the above content of the present invention, those skilled in the art may make various changes or combinations to the present invention and these equivalent changes or combinations shall also fall within the scope as defined by the appended claims of the present application.

In addition, the present invention is especially applicable to thin abrasive wheels. Common thin abrasive wheels have an outer diameter of 50 mm to 400 mm, and a thickness of 0.8 mm to 5 mm. Generally, it is appropriate for these thin abrasive wheels to joint with work pieces at a tangential contact speed of 72 m/s to 120 m/s. These thin resin abrasive wheels may include cutting wheels and angle grinding disks.

Moreover, the fiber reinforced mesh according to the present invention may be combined with various abrasive substrate materials to form abrasive wheels. For example, a combination of garnet and brown corundum may be used as the abrasive material, wherein garnet may account for 5% to 70% of the abrasive material by volume.

Although the several specific embodiments of the present invention are described through the appended drawings and the description as mentioned above, the above description is only for the purpose of clearly describing the preferred embodiments of the present invention rather than limiting the scope of the present invention in any way. The scope of the present invention is to be defined by the appended claims.

What is claimed is:

1. A fiber reinforced mesh for an abrasive tool, comprising:

a fiber fabric layer;

a resin layer coated on the fiber fabric layer; and wherein the resin layer comprises a weight per unit area of the fiber reinforced mesh of more than 3 g/m$^2$ and less than 80 g/m$^2$.

2. A fiber reinforced mesh for an abrasive tool, comprising:

a fiber fabric layer;

a resin layer coated on the fiber fabric layer; and wherein the resin layer comprises a weight of more than 1% and less than 15% of the total weight of the fiber reinforced mesh.

3. The fiber reinforced mesh of claim 1, wherein the weight of the resin layer per unit area of the fiber reinforced mesh is less than 65 g/m$^2$.

4. The fiber reinforced mesh of claim 1, wherein the weight of the resin layer per unit area of the fiber reinforced mesh is less than 45 g/m$^2$.

5. The fiber reinforced mesh of claim 1, wherein the resin layer comprises one of thermoset resins including phenolic resin, aniline-formaldehyde resin, melamine resin, epoxy resin or modified epoxy resin, furfural resin, phenol formaldehyde, furan resin, glyptal resin, polyester or modified polyester, and vulcanized rubber, or any combination thereof.

6. The fiber reinforced mesh of claim 1, wherein the material of the fiber fabric layer is fiberglass mesh, short fiberglass, or nylon yarn, or any combination thereof.

7. The fiber reinforced mesh of claim 2, wherein a weight of the resin layer is less than 10% of the total weight of the fiber reinforced mesh.

8. The fiber reinforced mesh of claim 2, wherein the weight of the resin material is 5%-14% of the total weight of the fiber reinforced mesh.

9. An abrasive tool, comprising:

an abrasive substrate layer, a first fiber reinforced mesh and a second fiber reinforced mesh that is different from the first fiber reinforced mesh, wherein each is independently provided inside or on a surface of the abrasive substrate layer, wherein each of the first and second fiber reinforced meshes independently comprise:

a fiber fabric layer; and a resin layer coated on the fiber fabric layer;

wherein the resin layer of the first fiber reinforced mesh comprises a weight per unit area of more than 3 g/m$^2$ and less than 80 g/m$^2$; and wherein the resin layer of the second fiber reinforced mesh comprises a weight per unit area of not less than 80 g/m$^2$.

10. The abrasive tool of claim 9, wherein the weight of the resin layer of the first fiber reinforced mesh is more than 1% and less than 25% of the total weight of the first fiber reinforced mesh, and the weight of the resin layer of the second fiber reinforced mesh is more than 25% of the total weight of the second fiber reinforced mesh.

11. The abrasive tool of claim 9, wherein the fiber reinforced meshes are all located inside the abrasive substrate layer of the abrasive tool rather than on an outer surface of the abrasive substrate layer.

12. The abrasive tool of claim 9, wherein the first fiber reinforced mesh and the second fiber reinforced mesh are provided on outer surfaces at two opposite sides of the abrasive substrate layer of the abrasive tool, respectively.

13. The abrasive tool of claim 9, wherein the first fiber reinforced mesh is overlaid on an outer surface of the abrasive substrate layer of the abrasive tool, the second fiber reinforced mesh is provided inside the abrasive tool, and a third fiber reinforced mesh is partially overlaid on the other outer surface of the abrasive substrate layer of the abrasive tool.

14. The abrasive tool of claim 9, wherein the abrasive tool comprises a thickness of 0.8 mm to 5 mm and an outer diameter of 50 mm to 400 mm.

15. The fiber reinforced mesh of claim 2, wherein the weight of the resin layer per unit area of the fiber reinforced mesh is more than 3 $g/m^2$ and less than 80 $g/m^2$.

16. The fiber reinforced mesh of claim 1, wherein the weight of the resin layer is more than 1% and less than 25% of the total weight of the fiber reinforced mesh.

17. The fiber reinforced mesh of claim 1, wherein the abrasive tool comprises a ratio of diameter-to-thickness (D:T) of 8 to 62.5.

* * * * *